United States Patent [19]

Hartman

[11] Patent Number: 4,795,084

[45] Date of Patent: Jan. 3, 1989

[54] CORNER STRUCTURE AND BLANK FOR A TRAY OR TRAY COVER

[75] Inventor: Andrew F. Hartman, Raleigh, N.C.

[73] Assignee: Timothy A. Canning, Raleigh, N.C.

[21] Appl. No.: 123,601

[22] Filed: Nov. 20, 1987

[51] Int. Cl.[4] ..... B65D 5/24

[52] U.S. Cl. ..... 229/175; 229/174; 229/186

[58] Field of Search ..... 229/172, 174, 175, 186

[56] References Cited

U.S. PATENT DOCUMENTS

| | | | |
|---|---|---|---|
| Re. 24,946 | 3/1961 | Burden | 229/175 |
| 1,667,017 | 4/1928 | Tinsley | 229/175 |
| 1,755,694 | 4/1930 | Keppler | 229/172 |
| 2,157,686 | 5/1939 | Ballard | 229/175 |
| 2,398,155 | 4/1946 | Platt | 229/175 |
| 3,049,280 | 8/1962 | Frankenstein | 229/175 |
| 4,371,110 | 2/1983 | Kulig | 229/175 |

FOREIGN PATENT DOCUMENTS

| | | | |
|---|---|---|---|
| 0639481 | 6/1950 | United Kingdom | 229/172 |

*Primary Examiner*—Jimmy G. Foster
*Assistant Examiner*—Gary E. Elkins
*Attorney, Agent, or Firm*—Rodgers & Rodgers

[57] ABSTRACT

Corner structure for an open tray or tray cover is formed from a unitary blank comprising a rectangular main panel, a first pair of outer side panels foldably joined to a first pair of opposite side edges of the main panel, a first pair of inner side panels foldably joined respectively to the edges of the first pair of outer side panels which are remote from the main panel, a first pair of base flaps foldably joined respectively to the edges of the first pair of inner side panels which are remote from the first pair of outer side panels, a second pair of outer side panels foldably joined respectively to a second pair of opposite side edges of the main panel, a pair of inner side panels foldably joined respectively to the edges of the second pair of outer side panels which are remote from the main panel, a second pair of base flaps foldably joined respectively to the edges of the second pair of inner side panels which are remote from the second pair of outer side panels, a collapsible web at each corner of the main panel and foldably joined to the adjacent end of each one of the first and second pairs of outer side panels, the outer corners of the first pair of inner side panels being configured to define trapezoidal cutaway areas, and a locking tab of trapezoidal configuration adjoined to each end of each base flap.

6 Claims, 2 Drawing Sheets

CORNER STRUCTURE AND BLANK FOR A TRAY OR TRAY COVER

TECHNICAL FIELD

This invention relates to containers such as are formed of paperboard and which may include a box like tray and a box like cover arranged to cooperate and close the tray.

BACKGROUND ART

U.S. Pat. No. 622,274 issued Apr. 4, 1899 for a paper box discloses double thickness side and end walls together with base flaps foldably joined to the inner panel of each side and end wall and which is disposed in flat face contacting relation with the bottom panel of the box. Such structure constitutes reinforcement for the side and end edges of the box.

U.S. Pat. No. 2,769,588 issued Nov. 6, 1956 discloses a box having bottom, side and end walls formed from a unitary blank and wherein suitable locking tab structure is provided for adjoining the corners of the side and end walls together with adhesive applied to certain areas of the blank to form a completed box.

Another structure is known and sometimes referred to as a "BEERS" box. This type of structure is used at retail outlets for packaging items such as folded shirts and the like. The "BEERS" box requires glue at its corners and is not characterized by a neat appearance wherein the corners are formed of side and end walls which are disposed at right angles to each other and is not mechanically strong. The "BEERS" box has the advantage that it can be shipped from the box manufacturer to the retailer and stored in flat collapsed form and thus does not require a substantial amount of space. This device is also simple to set-up.

Attractive sturdy rigid boxes which have square corners are not popular for certain purposes at retail outlets because they do not come in collapsed condition to the retailer and hence require a substantial amount of storage space. Such boxes have glued corners and are expensive.

SUMMARY OF THE INVENTION

According to this invention in one form, a box or tray having squared corners is shipped by the manufacturer in blank collapsed form to the retailer and is set up by the retailer without the use of glue.

A tray or tray cover formed according to one form of this invention is formed from a unitary blank and comprises a quadrilateral main panel having right angle corners, four side walls each of which includes an outer side panel foldably joined to an edge of the main panel, an inner side panel foldably joined to the edge of the outer side panel which is opposite from the main panel, a base flap foldably joined to the edge of the associated inner side panel remote from the fold line between the associated outer side panel and the associated inner side panel, the inner side panel being in close face contacting relation with the inner surface of the associated side panel and each base flap being in flat face contacting relation with the main panel, a locking tab having a locking edge and foldably joined to each end of the base flaps which are associated with one pair of opposite sides of the box together with a cutaway section formed in the outer corners of each inner side wall associated with the other pair of opposite sides of the tray or cover, the structure being held in setup condition by engagement of the locking edge of each locking tab with an edge of the adjacent cutaway area, and a collapsible web structure at each corner of the main panel foldably adjoined to the adjacent end edges of the outer side walls which intersect at each corner of the main panel.

BEST MODE OF CARRYING OUT THE INVENTION

Figure 1:
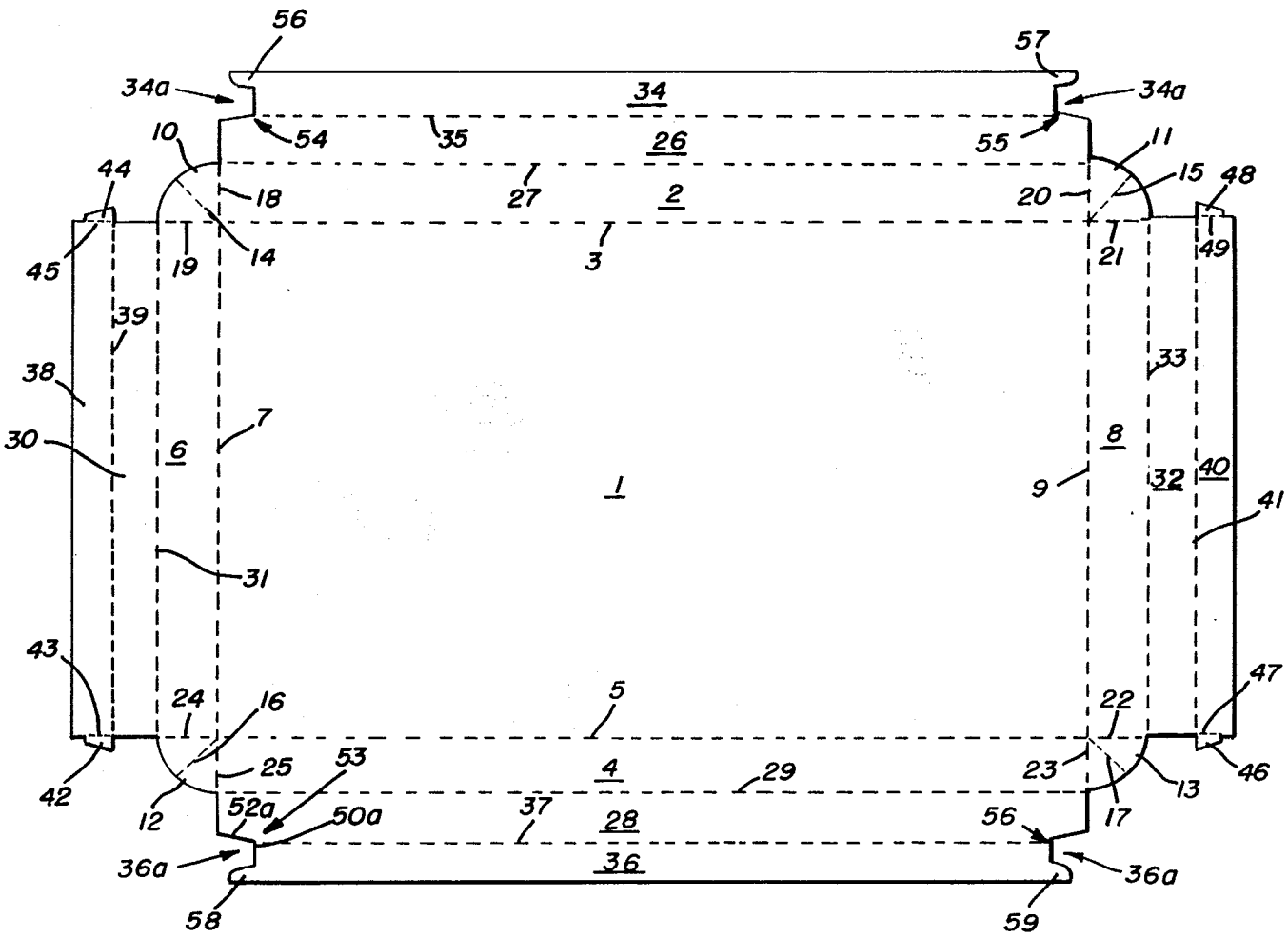
FIG. 1 is a plan view of a blank formed according to this invention as viewed from the inside of the blank.

With reference primarily to FIG. 1, the numeral 1 designates the main quadrilateral panel of the blank having right angle corners. Outer side panel 2 is foldably joined to main panel 1 along fold line 3 while outer side panel 4 is foldably joined to main panel 1 along fold line 5. Outer side panel 6 is foldably joined to main panel 1 along a fold line 7 and outer side panel 8 is foldably jointed to main panel 1 along fold line 9.

The outer side panels are interconnected by web structures 10, 11, 12 and 13 which are disposed at the four corners of main panel 1. Each web structure is collapsible along a fold line such as indicated at 14, 15, 16 and 17. Web 10 is foldably joined to outer side panel 2 along fold line 18 and to the adjacent end of outer side panel 6 along fold line 19. Web 11 is foldably joined to outer side panel 2 along fold line 20 and to outer side panel 8 along fold line 21 while web 13 is foldably joined along fold line 22 to the end of outer side panel 8 and along fold line 23 to the end of outer side panel 4. Web 12 is foldably joined to outer side panel 6 along fold line 24 and to outer side panel 4 along fold line 25.

Outer side panels 2, 4, 6 and 8 are reinforced. For example, inner side panel 26 is foldably joined to outer side panel 2 along a fold line 27 while inner side panel 28 is foldably joined to outer side panel 4 along fold line 29. In like fashion, inner side panel 30 is foldably joined to outer side panel 6, a long fold line 31 and inner side panel 32 is foldably joined to outer side panel 8 long fold line 33.

When the tray is assembled, inner side panels 26, 28, 30 and 32 are disposed in flat face contacting relation with the outer side panels 2, 4, 6 and 8 respectively.

Base panel 34 is foldably joined to inner side panel 26 along fold line 35 while base panel 36 is foldably joined to inner panel 28 along fold line 37. Base panel 38 is foldably joined to inner side panel 30 along fold line 39 and base panel 40 is foldably joined to inner side pane 32 along fold line 41. Base panels 34, 36, 38 and 40 are disposed in flat face contacting relation with main panel 1 when the tray is set up.

Figure 4:
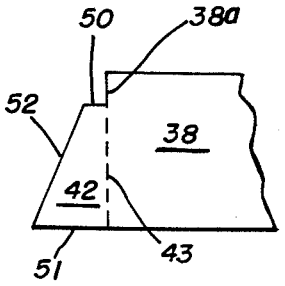
FIG. 4 is an enlarged fragmentary view of a locking tab and the panel to which it is adjoined.

For locking the elements in set up condition, locking tab 42 is foldably joined along fold line 43 to one end of base panel 38 and a similar locking tab 44 is foldably joined to the opposite end of base panel 38 along fold line 45. The edge 50 of locking tab 42 is spaced from the outer edge of base panel 38. At the other end of the blank, locking tab 46 is foldably joined to base panel 40 along fold line 47 and locking tab 48 is foldably joined to base panel 40 along fold line 49. All of the locking tabs are of identical construction. It is obvious from an inspection of these tabs that they are of trapezoidal configuration. As is clear from FIG. 4, tab 42, for example, is defined by its fold line 43, its short parallel edge 50 and its longer parallel edge 51 together with the angularly disposed edge 52. Edges 50, 51 and 52 are exposed and free of attachment to any other element.

For cooperating with the locking tabs, each end of each inner side panel 26 and 28 is cutaway at its outer corners to define a cutaway area partially indicated by edges of the cutout section. For example the short parallel edge 50 of locking tab 42 engages the short transverse edge or cut line 50*a* of the cutout corner portion of inner side panel 28. Edge 38*a* of panel 38 engages inner panel 28 adjacent fold line 37 and holds the inner side panel 28 in a normal position relative to main panel 1 and prevents collapse of the inner side panel 28. In like fashion, the cut edge 52*a* of cutaway area 53 abuts and coincides with the edge 52 of the locking tab 42. All of the locking tabs are configured in a manner identical to locking tab 42 and cooperation of locking tabs 44, 46 and 48 with associated cutaway areas 54, 56 and 55 is identical to that of locking tab 42 and its cutaway area 53.

Extending tabs 56 and 57 are formed at the outer corners of base flap 34 while identical extending tabs 58 and 59 are formed at the outer corners of base flap 36.

The cutaway end portions of the base panels 34 and 36 which are designated by the arrows 34*a* and 36*a* serve to facilitate locking and holding action of locking tabs 44, 48, 42 and 46. For example and with reference to locking tab 42, cutaway area 36*a* affords space into which the lower edge 43 of locking tab 42 is pressed. The memory or "flight" along fold line 43 causes tab 42 to press against the inner surface of outer side panel 4 and also causes edge 52 to engage securely the edge 52*a* while locking tab 42 snaps into secure locking position without overlapping edge 52*a*.

Figure 2:
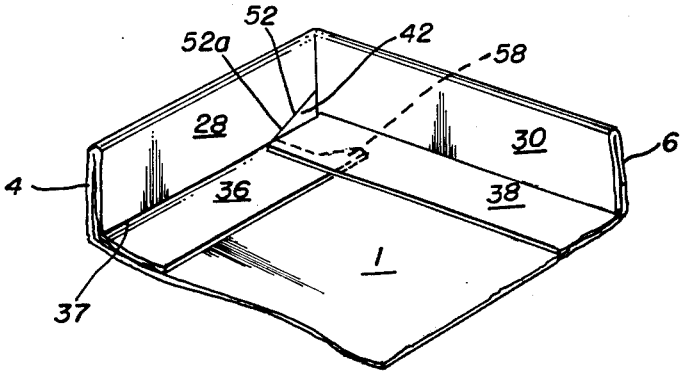
FIG. 2 is a fragmentary view of one corner of the container as viewed from inside when formed in set up condition.

In order to set up the carton so that each corner appears from the inside as shown in FIG. 2, the inner side panel 28 is folded inwardly along fold line 29 and the outer side panel 5 together with associated structure is folded along the fold line 5 into vertical position so as to cause the base flap 36 to lie in flat face contacting relation against the main panel 1. After panel 28 is in vertical position, inner side panel 30 is folded along fold line 31 into flat face contacting relation with the outer side panel 6 and outer side panel 6 is folded into perpendicular relation to main panel 1 which folding operation causes the base flap 38 to fall into flat face contacting relation with the main panel 1. During these folding operations, the web 12 collapses on fold line 16 and is captured between the adjacent ends of outer side panel 6 and inner side panel 30. During this folding operation, the locking tab 42 swings along its fold line 43 into a perpendicular position relative to main panel 1 and the locking edge 52 of locking tab 42 comes into abutting engagement with the edge 52*a* of cutaway area 53 and the set up corner appears as shown from inside in FIG. 2.

Figure 3:
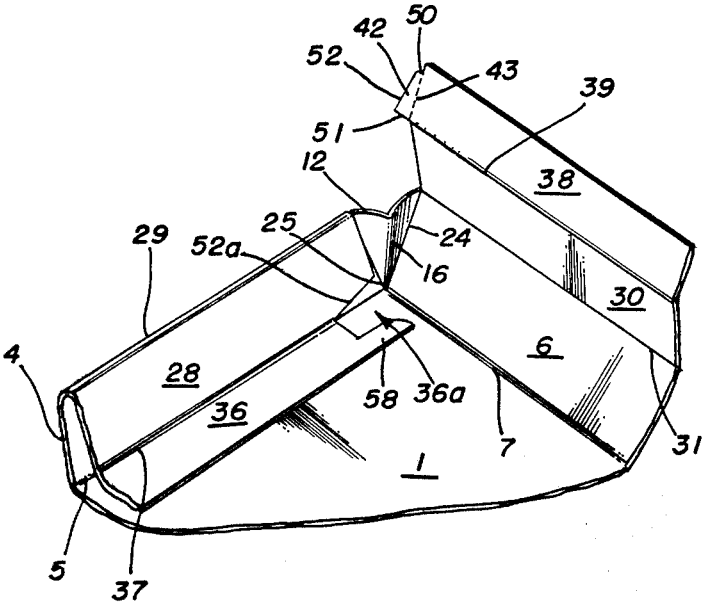
FIG. 3 is a view similar to FIG. 2 but which shows the principal locking elements during an intermediate stage of manipulation between the flat blank shown in FIG. 1 and the completed corner shown in FIG. 2.

FIG. 3 shows the folding of inner side panel 28 and of base flap 36 after completion of their folding operation and shows outer side panel 6, inner side panel 30 and base flap 38 during an intermediate stage of folding from the flat position represented in FIG. 1 to the set up condition shown in FIG. 2.

It is obvious that a tray or tray cover may be formed according to the invention. Minor changes in dimensions would be made to accommodate proper interfitting of the two components as is obvious.

From the foregoing discussion taken in conjunction with the drawing, it is clear that by the invention a sturdy attractive tray or tray cover is provided which requires no glue and which therefore is suitable for use at the retail level to package various items sold to the public and for use in many industrial applications.

What is claimed is:

1. Corner structure for a tray or tray cover formed from a unitary blank, said corner structure comprising a quadrilateral main panel with right angle corners and a pair of outer side panels each having opposite side edges and inner surfaces and said outer side panels having adjacent end edges and being foldably joined along one of said side edges respectively to edges of said main panel along fold lines which intersect at a corner of the tray, said outer side panels being perpendicular to said main panel, collapsed web structure foldably joined to the adjacent end edges of said outer side panels, a pair of inner side panels having opposite edges and foldably joined respectively along one of said edges to the other of said edges of said outer side panels which are remote from said main panel, said inner side panels having adjacent end edges and one of said inner side panels having a lower corner, each of said inner side panels being disposed in flat face contacting relation with the inner surface of its associated outer side panel, one of said inner side panels being of rectangular configuration and the end edge of the other of said inner side panels being configured to define the shorter parallel side of a trapezoid and another diagonal intersecting locking edge of said trapezoid, a base flap foldably joined respectively to each of said inner side panels along a fold line at the other edge thereof which is adjacent said main panel, said base flaps having adjacent ends and being disposed in flat face contacting relation with said main panel and an end edge of the base flap which is foldably joined to said other inner side panel intersecting an end of said shorter parallel side of said trapezoid, and a locking tab of trapezoidal configuration foldably joined along a fold line having a memory to the adjacent end of the one of said base flaps which is foldably joined to said one of said inner side walls, said locking tab having a lower edge and a locking edge and being disposed in perpendicular relation to its associated base flap and with its locking edge in engagement with said locking edge of said other inner side panel, an extending tab integral with and projecting longitudinally from said adjacent end of the one of said base flaps which is foldably joined to said other inner side panel, said extending tab defining a cutaway end portion of its associated base flap which affords space into which the lower edge of the adjacent locking tab is disposed so that the memory along the tab fold line causes the tab to press against the inner surface of the adjacent outer side panel and also causes said locking edge of said locking tab securely to engage said locking edge of said other inner side panel.

2. Corner structure according to claim 1 wherein the fold line between said locking tab and said one base flap extending from the lower corner of said one inner side panel a part only of the length of the end edge of said one base flap to expose an abutment edge of said one base flap for engaging the end edge of said other inner side panel adjacent the fold line between said other inner side panel and said base flap which is foldably adjoined thereto thereby to hold said one inner side panel in perpendicular relation to said main panel.

3. Corner structure according to claim 1 wherein said locking tab is disposed in the same plane as said other inner side panel.

4. Corner structure according to claim 1 wherein said extending tab is interposed between said main panel and the one of said base flaps which is foldably joined to said one inner side panel.

5. A unitary blank for forming a tray or tray cover and comprising a quadrilateral main panel having right angle corners, a first pair of outer side panels having opposite edges and being foldably joined along one of said edges to a first pair of opposite side edges of said main panel, a first pair of inner side panels having outer corners and opposite edges and being foldably joined respectively along one of said edges to the other of said edges of said first pair of outer side panels which are remote from said main panel, each of the outer corners of said first pair of inner side panels being configured to define cutaway areas to form an angular locking edge and a short transverse edge, a first pair of base flaps each having end edges and outer corners and being foldably joined respectively to the other of said edges of said first pair of inner side panels which are remote from said first pair of outer side panels, a second pair of outer side panels foldably joined respectively to a second pair of opposite side edges of said main panel, each of said first pair of outer side panels and of said second pair of outer side panels having opposite ends which are adjacent respectively to a corner of said main panel, a collapsible web at each corner of said main panel and foldably joined to an end of each one of said first pair of outer side panels and to an end of each one of said second pair of outer side panels, a second pair of inner side panels having opposite edges and being foldably joined respectively along one of said edges to the other of said edges of said second pair of outer side panels which are remote from said main panel, a second pair of base flaps each having opposite ends and being foldably joined respectively to the other of said edges of said second pair of inner side panels which are remote from said second pair of outer side panels, and a locking tab adjoined to each end of each of said second pair of base flaps, said cutaway area forming parts of the edges of a trapezoid and said locking tabs are of trapezoidal configuration each having a free and exposed long and a short parallel side and a third side perpendicular to said long and short sides, the shorter parallel side being spaced from the outer edge of the associated base panel and each of said locking tabs being arranged with its free and exposed longer parallel side in alignment with said edges of said second pair of inner side panels which are remote from said second outer side panels and with its third side foldably joined to the adjacent end edge of the associated one of said base flaps and each locking tab having a tab locking edge configured to match said locking edge of the adjacent cutaway area and said short parallel side being configured for engagement with said short transverse edge of one of said cutaway areas.

6. A unitary blank according to claim 5 wherein an extending tab projects longitudinally from the end edge of each of said first pair of base flaps at the outer corner thereof.

* * * * *